US012606954B2

(12) United States Patent
Hennig et al.

(10) Patent No.: US 12,606,954 B2
(45) Date of Patent: Apr. 21, 2026

(54) METHOD AND PROCESSING SYSTEM FOR REDUCING VOLATILE ORGANIC COMPOUNDS FROM WOOD CHIPS

(71) Applicant: FIBERBOARD GMBH, Baruth (DE)

(72) Inventors: Andre Hennig, Baruth (DE); Christian Dümichen, Baruth (DE); Martin Schwendy, Baruth (DE); Bernd Bungert, Berlin (DE); Thomas Heine, Berlin (DE)

(73) Assignee: FIBERBOARD GMBH, Baruth (DE)

( * ) Notice: Subject to any disclaimer, the term of this patent is extended or adjusted under 35 U.S.C. 154(b) by 640 days.

(21) Appl. No.: 17/802,051

(22) PCT Filed: Feb. 26, 2021

(86) PCT No.: PCT/EP2021/054788

§ 371 (c)(1),
(2) Date: Aug. 24, 2022

(87) PCT Pub. No.: WO2021/170779

PCT Pub. Date: Sep. 2, 2021

(65) Prior Publication Data

US 2023/0061371 A1 Mar. 2, 2023

(30) Foreign Application Priority Data

Feb. 28, 2020 (EP) ..... 20160148

(51) Int. Cl.
*D21B 1/02* (2006.01)
*D21B 1/06* (2006.01)

(52) U.S. Cl.
CPC ..... *D21B 1/023* (2013.01); *D21B 1/021* (2013.01); *D21B 1/063* (2013.01)

(58) Field of Classification Search
CPC ..... D21B 1/023; D21B 1/021; D21B 1/063
USPC ..... 162/60
See application file for complete search history.

(56) References Cited

U.S. PATENT DOCUMENTS

| | | | | |
|---|---|---|---|---|
| 4,347,101 | A * | 8/1982 | Villavicencio | D21B 1/12 162/28 |
| 8,832,964 | B2 * | 9/2014 | Foxen | C09F 3/00 34/396 |
| 2013/0263501 | A1 * | 10/2013 | Monroe | C10L 9/083 47/1.4 |

FOREIGN PATENT DOCUMENTS

| | | | |
|---|---|---|---|
| DE | 69819546 | T2 | 8/2004 |
| EP | 1597427 | A1 | 11/2005 |
| WO | 9010108 | A1 | 9/1990 |
| WO | 9910594 | A1 | 3/1999 |
| WO | 2004072362 | A1 | 8/2004 |

OTHER PUBLICATIONS

Jun. 11, 2025. Brazilian Office Action from corresponding Application No. BR112022016795-4.

* cited by examiner

*Primary Examiner* — Jacob T Minskey
(74) *Attorney, Agent, or Firm* — Harness, Dickey & Pierce, P.L.C.

(57) ABSTRACT

The disclosure relates to a method for reducing volatile organic compounds (VOC) from wood chips for wood fibre production in a processing system, at least comprising the following consecutive steps: a first thermal treatment of the wood chips in a first thermal treatment device, which is designed to receive VOC-containing waste gases; cleaning the wood chips in a washing device; a second thermal treatment of the wood chips in a second thermal treatment device, which is designed to receive and separate VOC-containing waste gases; digesting the wood chips in a digester, which is designed to receive and separate VOC-containing waste gases; and crushing the wood chips in a refiner, which is designed to separate VOC-containing waste gases. This allows for an efficient, and thus energy-optimised or environmentally friendly and therefore also cost-optimised reduction of volatile organic compounds from wood chips.

10 Claims, 1 Drawing Sheet

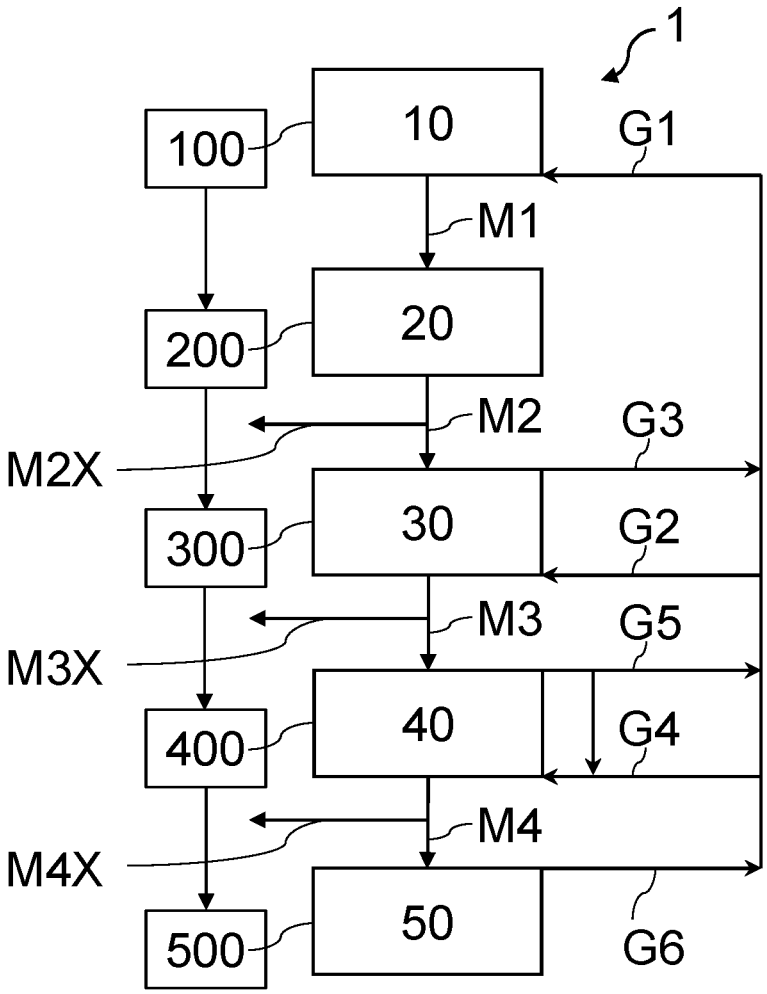
1
10
100
G1
M1
20
200
M2
G3
M2X
30
300
G2
M3
G5
M3X
40
400
G4
M4
M4X
50
500
G6

METHOD AND PROCESSING SYSTEM FOR REDUCING VOLATILE ORGANIC COMPOUNDS FROM WOOD CHIPS

CROSS-REFERENCE TO RELATED APPLICATIONS

This application is a U.S. National Phase Application under 35 U.S.C. 371 of International Application No. PCT/EP2021/054788, filed on Feb. 26, 2021, which claims the benefit of European Patent Application No. 20160148.1, filed on Feb. 28, 2020. The entire disclosures of the above applications are incorporated herein by reference.

FIELD

The disclosure relates to a method for reducing volatile organic compounds from wood chips for wood fiber production in a processing system.

The disclosure further relates to a processing system for reducing volatile organic compounds from wood chips for wood fiber production.

BACKGROUND

This section provides background information related to the present disclosure which is not necessarily prior art.

A continuous manufacturing process of wood fibers according to the dry and wet method, based on lignocellulosic material such as wood, straw or bagasse, includes, among others, crushing the raw material into free fibers or fiber aggregates, which in subsequent steps are coated with an adhesive, dried, formed and pressed into a final product, the so-called board or wood fiber board. Today, the release of fibers from the raw material is preferably carried out in a so-called thermo-mechanical process in one step or in a thermal and mechanical process step in two separate phases.

Prior to the first thermal treatment, the wood chips are usually washed to remove contaminants such as soil or stones therefrom. The thermal treatment, i.e., the heating of the raw material, is carried out, among others, in a first thermal treatment device at a preferred temperature of up to about 100 degrees Celsius, in particular under atmospheric pressure, and then in a preferably pressurized second thermal treatment device at a temperature of, by way of example, about 150 to 190 degrees Celsius, in particular under a pressure of about 4 to 13 bar. The residence time of the wood chips in the thermal treatment devices can be adjusted depending on the prevailing process conditions and, by way of example, can range from about 1 to 10 minutes. According to the prior art, thermal heating in the second thermal treatment device is preferably carried out by means of steam. Then, a mechanical processing is carried out in a refiner. The residence time of the wood chip raw material in the refiner is of short duration. The energy that is converted to mechanical energy in connection with the mechanical processing is converted to heat in the reduction zone and occurs as exhaust gas, in particular steam, in the processing system that is generated from the moisture in the raw material.

Typically, after the refinement of the wood fibers in the refiner, they are pneumatically transported to a fiber dryer where the drying process is carried out with a large air volume and a controlled inlet air temperature of about 140 to 200 degrees Celsius, depending on the current fiber moisture content. The dried fibers are then further transported to forming, prepressing and finally final pressing of the board.

In the prior art, the wood emissions released during this process, primarily in the second thermal treatment device, are transported from the first thermal treatment device via the refiner along with the fiber bulk material to the dryer where the major part is separated from the fibers and finally moist drying air is discharged from the dryer to the atmosphere. These emissions contain mainly volatile organic substances, so-called volatile organic compounds (VOCs). The remaining quantities that do not leave the dryer follow the fiber flow to the downstream processing units, where they are successively released into the surrounding atmosphere or appear as a residual product in the finished product, the board. Thus, the discharge of emissions to the atmosphere also takes place from the finished product.

It is previously known from WO 99/10594 that the second thermal treatment device is equipped with an upper outlet for degassing the organic emissions released there. Here, the steam is introduced in the lower part of the first thermal treatment device and the wood chips entering the upper part of the first thermal treatment device are washed in the counterflowing steam during condensation. This is accomplished by the steam moving upwardly through the wood chip column to the colder wood chips in the upper part of the first thermal treatment device. The released emissions, exhaust air and steam, resulting from the evaporation of moisture in the wood chips, are separated and disposed through the outlet in a corresponding device. According to this publication, it is also known that the wood chips are transported from the first thermal treatment device to the refiner by means of a screw conveyor that compresses and dewaters the wood chips during transport.

According to the published patent application EP1597427 A1, a method is known in which the exhaust gases produced during compression in a screw conveyor are disposed via an outlet arranged in the compression zone. The system according to the previously known disclosure is characterized in that an exhaust gas outlet is arranged in the compression zone for discharging vaporized moisture, which is produced during compression of the wood chips and contains VOC-containing exhaust gases.

During the compression of the wood chips in the screw conveyor, water is squeezed out, which contains a large portion of the remaining wood emissions. An outlet in the compression zone allows the water to evaporate and the released emissions to be discharged through the outlet. By collecting and redirecting the emissions released in the compression zone directly and on-site, a much higher concentration of emissions is achieved than in the case they instead had to be transported further with the fiber mass and mixed with the drying air, which represents a very large gas stream and thus has a lower concentration according to other prior art. Thus, a more efficient handling of the exhaust gases from the first thermal treatment is achieved hereby.

However, in terms of environmentally friendly wood processing, there is a need to extract the VOCs even more efficiently from the wood chips, and this should also be done in an energy-saving manner likewise for environmentally friendly reasons.

SUMMARY

This section provides a general summary of the disclosure, and is not a comprehensive disclosure of its full scope or all of its features.

According to the disclosure, the object is achieved by a method for reducing volatile organic compounds from wood chips for wood fiber production, and a processing system for carrying out the method comprising the features of the inde-pendent claims. Preferred embodiments of the disclosure are disclosed in the sub-claims and in the following description, which may respectively individually or in any combination constitute an aspect of the disclosure.

Thus, the disclosure relates to a method for reducing volatile organic compounds, VOCs, from wood chips for wood fiber production in a processing system, comprising at least the following successive steps:

- first thermal treatment of the wood chips in a first thermal treatment device which is configured to receive VOC-containing exhaust gases;
- cleaning the wood chips in a washing device;
- second thermal treatment of the wood chips in a second thermal treatment device which is configured to receive and discharge VOC-containing exhaust gases;
- cooking the wood chips in a digester which is configured to receive and discharge VOC-containing exhaust gases; and
- crushing the wood chips in a refiner which is configured to discharge VOC-containing exhaust gases.

The basic idea of the disclosure is thus that VOC-containing exhaust gases, which result in particular from thermal treatment steps of the wood chips, are fed back into the processing system in different ways. As a result, wood chips according to the method of the disclosure are provided with an increased number and duration of contacts of the wood chips with VOC-releasing temperatures in the corresponding processing system compared to previously known methods or processing systems, wherein the processing system feeds the VOC-containing exhaust gases, which are highly tempered, back into the processing system or recycles them as efficiently as possible. This means that the wood chips are heated and freed from VOCs in an environmentally friendly manner. Although the VOC-containing exhaust gases are recycled to previous process stages, the wood chips do not absorb the VOCs that have already been discharged, but use the existing process heat to discharge further VOCs. These are removed from the processing system in further process steps.

The processing system according to the disclosure comprises three heat treatment stages and thus more than the previously known prior art. These heat treatment stages take place in the first thermal treatment device, in the second thermal treatment device and in the digester. This makes it possible, without significant additional expense, to introduce a further heat treatment stage, so that preferably three heat treatment stages are provided, which ensure an efficient discharge of VOCs from wood chips.

In principle, it is envisaged in the sense of the disclosure that VOC-containing exhaust gases have a high temperature. In particular, this means a temperature greater than the boiling temperature of water, i.e. 100 degrees Celsius.

The first thermal treatment of the wood chips in the first thermal treatment device, which is designed to receive VOC-containing exhaust gases, results in the wood chips being heated a first time. The heating can be effected by means of a heating device and/or by VOC-containing exhaust gases from later, especially thermal, treatment steps. This first thermal treatment is carried out with further non-wood particles between the wood chips, for example soil or stones. These non-wood particles are indeed washed out in the next step by means of cleaning, so that heating seems uneconomical. However, it has been found that cleaning of the wood chips in the washing device is more thorough if the wood chips and the other non-wood particles are introduced into the washing device at an elevated temperature. The high temperature may result in the release of VOCs from the wood chips. It is possible to discharge VOC-containing exhaust gases from the first thermal treatment device. Preferably, the first thermal treatment of the wood chips is carried out with a water-containing, in particular a water-based, medium.

Exemplarily and independently of other features, it is possible that the first thermal treatment of the wood chips in the first thermal treatment device is carried out by use of steam, preferably water vapour. Here, a part of the VOCs may be transferred from the wood chips to the steam. This VOC-containing steam can be discharged from the first thermal treatment device, preferably from its upper section and, for example, via a pipe line arranged on the roof. Alternatively, or in addition to discharging the VOC-containing vapour, some or all of the vapour may condense and release VOCs from the wood chips as a condensate. This VOC-containing condensate may be forwarded, for example, to the washing device and/or to a water conditioning system.

Cleaning of the wood chips in a washing device is performed in particular at a temperature above room temperature and less than or equal to the boiling temperature of water, in particular between 80 and 100 degrees Celsius. An elevated temperature allows for better separation of wood chips and foreign material. Thus, foreign material that is not wood chips is filtered out of the processing system and discharged. Preferably, the cleaning of the wood chips is carried out with a water-containing, in particular a water-based, medium.

It is an advantageous option that the washing device receives the aforementioned VOC-containing condensate from the first thermal treatment device. This VOC-containing condensate can be discharged from the processing system together with VOC released during washing.

The second thermal treatment of the wood chips in the second thermal treatment device is configured to receive and discharge VOC-containing exhaust gases, in particular into the first thermal treatment device. The second thermal treatment takes place pressureless at a temperature above room temperature, in particular at a temperature less than or equal to the boiling temperature of water, i.e. less than or equal to 100 degrees Celsius. An elevated temperature allows better release of VOCs from the wood chips. The VOC-containing exhaust gases are discharged from the second thermal treatment device and/or forwarded to the first thermal treatment device. Further, VOC-containing exhaust gases from a subsequently used device for carrying out the process may be fed into the second thermal treatment device to further heat the wood chips and/or to release VOCs.

Exemplarily and independently of other features, it is possible that the second thermal treatment of the wood chips in the second thermal treatment device is carried out by means of steam, preferably water vapour. In this process, a part of the VOCs may be transferred from the wood chips to the steam. This VOC-containing steam can be discharged from the second thermal treatment device, preferably from its upper section and, for example, via a pipe line arranged on the roof. Alternatively, or in addition to discharging the VOC-containing vapour, some or all of the steam may condense and release VOCs from the wood chips as condensate. This VOC-containing condensate can, for example, be forwarded to a stuffing screw and/or a digester and/or to a water conditioning system.

Cooking of the wood chips in the digester, which is designed to receive and discharge VOC-containing exhaust gases, takes place at a temperature above room temperature, in particular between and including 3 bar to 15 bar inclusive, preferably between and including 5 bar to 13 bar inclusive, preferably 9 bar, at a temperature greater than the boiling temperature of water, i.e. 100 degrees Celsius. An elevated temperature allows a better release of VOCs from the wood chips. Preferably, the cleaning of the wood chips is carried out with a water-containing, in particular water-based, medium. The first and the second thermal treatments have heated and softened the wood chips such that VOCs contained in the wood chips are released from the digester in an efficient manner. Preferably, a droplet separator is provided downstream of the digester.

It is an advantageous option that a stuffing screw upstream of the digester and/or the digester receives the aforementioned VOC-containing condensate from the second thermal treatment device. This VOC-containing condensate can be discharged from the processing system via the stuffing screw and/or via the digester, together with any VOC optionally released during cooking.

Subsequently, the wood chips are crushed in the refiner, which is configured to discharge VOC-containing exhaust gases. These VOC-containing exhaust gases can be recycled to the processing system in the refiner and/or in a system downstream of the refiner, so that the waste heat is utilized and energy costs are saved.

According to a preferred embodiment of the disclosure, it is provided that the first thermal treatment device is configured to receive VOC-containing exhaust gases, which are discharged from the second thermal treatment device, the digester and/or the refiner. The additional energy required in the processing system to heat the first thermal treatment device is reduced compared to an embodiment without this exhaust gas feed line. It is also possible to heat the wood chips solely via the VOC-containing exhaust gases. These VOC-containing exhaust gases fed in thus promote the discharge of VOCs from wood chips already in the first thermal treatment device. Thereby, the wood chips are heated in such a way that they are cleaned more efficiently in the washing device compared to non-heated wood chips.

According to a preferred embodiment of the disclosure, it is provided that the second thermal treatment device is configured to receive VOC-containing exhaust gases that are discharged from the digester and/or refiner. The additional energy required in the processing system to heat the second thermal treatment device is reduced compared to an embodiment without this exhaust gas feed line. It is also possible to heat the wood chips solely via the VOC-containing exhaust gases. These VOC-containing exhaust gases fed in thus promote the discharge of VOCs from wood chips already in the first thermal treatment device. Thereby, the wood chips are heated in such a way that they are cleaned more efficiently in the washing device compared to non-heated wood chips.

According to a preferred embodiment of the disclosure, it is provided that the VOCs are discharged from the processing system from the first thermal treatment device, the second thermal treatment device, the digester and/or the refiner. It is possible that the VOCs are discharged from only one of these stations. For example, this may occur in the first thermal treatment device, the second thermal treatment device, and/or the refiner in the gaseous phase. It is also possible that VOC-containing liquid which flows out the processed wood chips is drained from the refiner. In the digester, the VOCs can be removed in the gaseous phase and/or from the cooking medium as it flows out of the digester. Moreover, the VOCs can float as an oily medium on a water surface and be discharged from the digester. The discharge in the gas phase takes place by means of an outlet in the upper part of the vessel. The drainage takes place with the aid of gravity from the lower part of the vessel. At least partially, the VOCs may leave the processing system via the water of the digester, or as oil phases on the water, if e.g. a discharge screw or stuffing screw is arranged between the digester and the refiner. Preferably, the VOCs leave the processing system over a substantial portion, for example greater than 50 percent, via the water of the washing device, or as oil phases on the water. The basic idea here is that the VOCs are first concentrated and then disposed of, in particular via washing and squeezing water.

According to a preferred embodiment of the disclosure, it is provided that the VOCs from the processing system are discharged from the washing device. Optionally or additionally, it is provided that the processing system comprises a stuffing screw along a material flow of the wood chips between the second thermal treatment device and the digester. In particular, the stuffing screw is designed such that VOCs can be discharged from the processing system via the stuffing screw. Further optionally or additionally provided is that the processing system comprises a discharge screw along a material flow between the digester and the refiner, wherein the VOCs from the processing system are discharged from the discharge screw. The discharge screw can be designed as a stuffing screw. It has been found that VOCs at these regions can be removed with advantageous efficiency from the washing device, from the stuffing screw, as well as from the discharge screw from the processing system, without the process being substantially negatively affected, for example by an unfavourable temperature development.

According to a preferred embodiment of the disclosure, it is provided that

- the first thermal treatment of the wood chips is performed at 80 degrees Celsius for 5 to 10 minutes; and/or
- the second thermal treatment of the wood chips is performed at 100 degrees Celsius for 5 to 10 minutes; and/or
- the cooking of the wood chips takes place between 140 to 180 degrees Celsius for 2 to 5 minutes. Both the temperature data and the time data include a respective upward and downward variation of 10 percent, inclusive. It has been found that the wood chips can be particularly advantageously reduced in terms of VOCs in these ranges during the respective process steps. In this regard, each preferred range can be advantageous on its own and becomes steadily more advantageous with further preferred ranges that can be freely combined with each other.

According to a preferred embodiment of the disclosure, it is provided that the first thermal treatment device is heated at least partially, preferably completely, by exhaust vapours from the digester. Such exhaust vapours are also known as fever vapours. This has been shown to be energy efficient, wherein sufficient energy is incorporated to support VOC reduction in the process.

According to a preferred embodiment of the disclosure, it is provided that the VOC-containing exhaust gases from the digester and the refiner are forwarded in a combined manner. In this way, the temperature of the exhaust gas from the digester and the refiner is averaged, so that the necessary proportion of self-heating of the container receiving the combined exhaust gases can be reliably determined and undesired temperature fluctuations in the receiving container are reduced. The receiving container is/are in particular the first thermal treatment device, the second thermal treatment device and/or the digester.

According to a preferred embodiment of the disclosure, it is provided that the VOC-containing exhaust gases from the second thermal treatment device, the digester and the refiner are forwarded in a combined manner. In this way, the temperature of the exhaust gas from the second thermal treatment device, the digester and the refiner is averaged, so that the necessary proportion of self-heating of the container receiving the combined exhaust gases can be reliably determined and undesired temperature fluctuations in the receiving container are reduced. The receiving container is in particular the first thermal treatment device.

According to a preferred embodiment of the disclosure, it is provided that the digester is configured to receive VOC-containing exhaust gases, which are discharged from the digester and/or the refiner. Exhaust gas heat can thus be returned to the digester. This exhaust gas heat can thus be returned into the digester. Moreover, this exhaust gas heat can be elevated by use of exhaust gases of the refiner. The discharge of VOCs from the wood chips can thus be promoted in an energy-efficient way.

In accordance with a preferred embodiment of the disclosure, it is provided that the VOC-containing exhaust gases are introduced into a bottom section of the digester, the first and/or the second thermal treatment device. Thus, the heated wood chips are brought into contact with a gas stream along a vertical axis, which is as long as possible, of the digester, the first and/or second thermal and/or the second thermal treatment device in order to absorb the VOCs of the gas stream in the liquid. Thus, the VOC-containing exhaust gas is efficiently utilized. This measure aims to heat the wood chips as efficiently as possible and to ensure a comprehensive VOC discharge.

According to a preferred embodiment of the disclosure it is provided that the material flow of the wood chips takes place

- from the first thermal treatment device into the washing device;
- from the washing device into the second thermal treatment device;
- from the second thermal treatment device into the digester; and
- from the digester into the refiner. It has been found, that by this material flow in connection with measures of the aforementioned method an efficient discharge of VOCs is achieved. This means that VOCs can be removed from the wood chips as much as possible with a minimum of energy consumption. The heating of the still contaminated wood chips in the first thermal treatment device prior to feeding into the washing device increases the efficiency, because the dirt heated together with the wood chips can be easily released from the wood chips.

Furthermore, the disclosure relates to a processing system for reducing volatile organic compounds, VOCs, from wood chips for wood fiber production for carrying out a method according to at least one of the preceding items, comprising:

- a first thermal treatment device adapted to receive VOC-containing exhaust gases for a first thermal treatment of the wood chips;
- a washing device for cleaning the wood chips;
- a second thermal treatment device, adapted to receive and discharge VOC-containing exhaust gases for a second thermal treatment of the wood chips;
- a digester, configured to receive and discharge VOC-containing exhaust gases for cooking the wood chips;
- a refiner, which is designed to discharge VOC-containing exhaust gases for crushing the wood chips. The processing system enables a cost-effective and environmentally friendly discharge of VOCs from wood chips, wherein the aforementioned embodiments, are equally applicable.

Where the terms pipe system or pipe sections are used in the following, this preferably refers to conveying means for exhaust gases and/or liquids. The conveying means can be closed or open pipes.

If the terms "heating system" or "heating medium line sections" are used in the following, this preferably refers to conveying means for hot exhaust gases and/or hot liquids.

Where the terms wood chip material flow system or material flow line are used hereinafter, this preferably refers to conveying means for the wood chips being processed.

According to a preferred embodiment of the disclosure, it is provided that the processing system comprises a conduit system with conduit sections, the conduit sections being arranged and configured to convey VOC-containing exhaust gases discharged from the second thermal treatment device, the digester and/or the refiner into the first thermal treatment device. The additional energy required in the processing system to heat the first thermal treatment device is reduced compared to an embodiment without this exhaust gas supply line. It is also possible to heat the wood chips exclusively via the VOC-containing exhaust gases. These VOC-containing exhaust gases fed in thus already promote the precipitation of VOCs from wood chips in the first thermal treatment device. Thereby, the wood chips are heated in such a way that they are cleaned more efficiently in the washing device compared to non-heated wood chips.

According to a preferred embodiment of the disclosure, it is provided that the processing system comprises a conduit system with conduit sections, the conduit sections being arranged and configured to pass VOC-containing exhaust gases discharged from the digester and/or the refiner into the second thermal treatment device. The additional energy required in the processing system to heat the second thermal treatment device is reduced compared to an embodiment without this exhaust gas supply line. It is also possible to heat the wood chips exclusively via the VOC-containing exhaust gases. These VOC-containing exhaust gases fed in thus already promote the precipitation of VOCs from wood chips in the first thermal treatment device. Thereby, the wood chips are heated in such a way that they are cleaned more efficiently in the washing device compared to non-heated wood chips.

According to a preferred embodiment of the disclosure, it is provided that the processing system comprises a conduit system with conduit sections, the conduit sections being arranged and configured to discharge the VOCs from the first thermal treatment device, the second thermal treatment device, the digester and/or the refiner. It is possible that the VOCs are discharged from only one of these stations. For example, this may be done in the first thermal treatment device, the second thermal treatment device and/or the refiner in the gas phase. It is also possible for liquid containing VOCs to flow out of the refiner from the processed wood chips. In the digester, the VOCs can be eliminated in the gaseous phase and/or from the cooking medium as it flows out of the digester. Also, the VOCs can float as an oily medium on a water surface and be discharged from the digester. The discharge in the gas phase takes place by means of a vent in the upper part of the vessel. The discharge takes place with the help of gravity from the lower vessel area. The VOCs can at least partially leave the processing system via the water of the digester, or leave as oil phases on the water, if, for example, a discharge screw, in particular a plug screw, is arranged between the digester and the refiner. Preferably, the VOCs leave the processing system over a substantial part, for example greater than 50 percent, via the water of the washing device, or as oil phases on the water. The basic idea here is that the VOCs are first concentrated and then disposed of, in particular via washing and squeezing water.

According to a preferred embodiment of the disclosure, it is provided that the processing system comprises a conduit system with conduit sections, wherein the conduit sections are arranged and configured to discharge VOCs from the washing device and/or that the processing system comprises a stuffing screw along a material flow between the second thermal treatment device and the digester, wherein the VOCs can be removed from the processing system from the stuffing screw via conduit sections of the conduit system and/or that the processing system has a discharge screw along a material flow between the digester and the refiner, wherein the VOCs can be discharged from the processing system from the discharge screw via line sections of the line system. The discharge screw may be in the form of a plug screw. It has been found that VOCs at these sections can be removed with advantageous efficiency from the washing device, as well as from the stuffing screw, as well as from the discharge screw from the processing system, without the process being substantially negatively affected, for example by an unfavourable temperature development.

According to a preferred embodiment of the disclosure, it is provided that the processing system comprises a heating system with heating medium line sections, wherein the heating medium line sections are arranged and formed to heat the first thermal treatment device at least partially, preferably completely, via exhaust vapours of the digester. Such exhaust vapours are also known as sweat vapours. This has been shown to be energy efficient, with sufficient energy being incorporated to assist VOC reduction in the process.

According to a preferred embodiment of the disclosure, it is provided that. the processing system comprises a duct system having duct sections, the duct sections being arranged and configured to pass the VOC containing exhaust gases from the digester, refiner together. In this way, the temperature of the exhaust gas from the digester and the refiner is averaged, so that the necessary proportion of the self-heating of the container receiving the combined exhaust gases can be reliably determined and undesirable temperature fluctuations in the receiving container are reduced. The receiving vessel is or are in particular the first thermal treatment device, the second thermal treatment device and/or the digester.

According to a preferred embodiment of the disclosure, it is provided that the processing system comprises a conduit system with conduit sections, the conduit sections being arranged and configured to convey the VOC-containing exhaust gases of the digester, the refiner and the second thermal treatment device in a combined manner. In this way, the temperature of the exhaust gas from the second thermal treatment device, the digester and the refiner is averaged so that the necessary proportion of self-heating of the container receiving the combined exhaust gases can be reliably determined and undesirable temperature fluctuations in the receiving container are reduced. The receiving vessel is in particular the first thermal treatment device.

According to a preferred embodiment of the disclosure, it is provided that the processing system comprises a conduit system with conduit sections, wherein the digester and the conduit sections are arranged and configured to introduce exhaust gases containing VOCs discharged from the digester and/or the refiner into the digester. Exhaust gas heat can thus be returned to the digester. This exhaust gas heat can also be increased with exhaust gases from the refiner. The separation of VOCs from the wood chips can thus be promoted in an energy-efficient manner.

According to a preferred embodiment of the disclosure, it is provided that the digester comprises a bottom section configured to receive exhaust gases containing VOCs from the digester, the first thermal treatment device and/or the second thermal treatment device via conduit sections of a conduit system. Thus, the heated wood chips are brought into contact with a gas stream along as long a vertical extension axis of the digester, the first thermal treatment device and/or the second thermal treatment device as possible in order to absorb the VOCs of the gas stream in the liquid. Thus, the exhaust gas containing VOCs is efficiently utilised. This measure aims to heat the wood chips as efficiently as possible and to ensure comprehensive VOC elimination.

According to a preferred embodiment of the disclosure, it is provided that the processing system comprises a wood chip material flow system with material flow lines, wherein the material flow lines for a material flow of the wood chips are arranged between:

the first thermal treatment device and the washing device;

the washing device and the second thermal treatment device;

the second thermal treatment device and the cooker; and the cooker and the refiner. It has been found that efficient VOC removal is achieved by this material flow in combination with measures of the aforementioned process. This means that VOCs are separated from the wood chips as comprehensively as possible with low energy input. Heating the still contaminated wood chips in the first thermal treatment device before introducing them into the washing device also increases efficiency because the dirt heated with the wood chips can be well dissolved from the wood chips.

Further areas of applicability will become apparent from the description provided herein. The description and specific examples in this summary are intended for purposes of illustration only and are not intended to limit the scope of the present disclosure.

DRAWINGS

The drawing described herein is for illustrative purposes only of selected embodiments and not all possible implementations, and are not intended to limit the scope of the present disclosure.

In the following, the disclosure is explained exemplarily with reference to the accompanying drawing based on the preferred exemplary embodiments, wherein the features shown below both individually and in combination may represent an aspect of the disclosure. In the drawing:

FIG. 1 shows a method for reducing volatile organic compounds from wood chips for wood fiber production in a processing system, with representation of the material flow and the exhaust gas flow.

DETAILED DESCRIPTION

Example embodiments will now be described more fully with reference to the accompanying drawing.

FIG. 1 shows a schematic illustration of a processing system 1 for carrying out a method for reducing volatile organic compounds, VOCs, from wood chips for wood fiber production.

Structurally, the processing system 1 comprises at least a first thermal treatment device 10, a washing device 20, a second thermal treatment device 30, a digester 40 and a refiner 50.

In this regard, the processing system 1 for reducing VOCs from wood chips according to FIG. 1 performs the following process steps:

In the first thermal treatment device 10 a first thermal treatment of wood chips 100 is carried out.

Subsequently, in the washing device 20 a cleaning of the wood chips 200 takes place.

After the cleaning of the wood chips 200, they are thermally treated 300 a second time in the second thermal treatment device 30.

The wood chips that have been thermally treated 300 the second time in the second thermal treatment device 30 are subsequently cooked 400 in the digester 40.
cooked.

After the cooking of the wood chips 400 in the digester 40, the wood chips are crushed 500 in the refiner 50.

Within the processing system 1, for the energy-efficient and environmentally friendly reduction of VOCs from wood chips according to FIG. 1 a gas flow as follows occurs:

By use of the first thermal treatment device 10 VOC-containing exhaust gases G1 are received.

By use of the second thermal treatment device 30, VOC-containing exhaust gases G2 are received.

Furthermore, the second thermal treatment device 30 discharges VOC-containing exhaust gases G3.

The digester 40 receives VOC-containing exhaust gases G4. Furthermore, the digester 40 discharges VOC-containing exhaust gases G5.

The refiner 50 is at least configured to discharge VOC-containing exhaust gases G6. Optionally a reception of VOC-containing exhaust gases from the digester 40 is possible.

The chips which release VOCs follow a material flow within the processing system as follows:

From the first thermal treatment device 10 into the washing device 20 M1, from the washing device 20 into the second thermal treatment device 30 M2, from the second thermal treatment device 30 into the digester 40 M3, and from the digester 40 into the refiner 50 M4.

Stated differently, the processing system 1 for reducing volatile organic compounds, VOC, from wood chips for wood fiber production for carrying out the aforementioned process comprises:

- a first thermal treatment device 10, configured to receive VOC-containing exhaust gases G1 for a first thermal treatment of the wood chips 100;
- a washing device 20 for cleaning the wood chips 200;
- a second thermal treatment device 30, configured to receive G2 and discharge G3 VOC-containing exhaust gases for a second thermal treatment of the wood chips 300;
- a digester 40 configured to receive G4 and discharge G5 VOC-containing exhaust gases for cooking the wood chips 400; and
- a refiner 50 configured to discharge VOC-containing exhaust gases G6, for crushing the wood chips 500.

The method for reducing volatile organic compounds, VOCs, from wood chips for wood fiber production in a processing system 1, comprises, in other words, at least the following successive steps:

- first thermal treatment of the wood chips 100 in a first thermal treatment device 10, configured to receive G1 VOC-containing exhaust gases;
- cleaning the wood chips 200 in a washing device 20;
- second thermal treatment of the wood chips 300 in a second thermal treatment device 30 configured to receive G2 and discharge G3 VOC-containing exhaust gases;
- cooking the wood chips 400 in a digester 40 configured to receive G4 and discharge G5 VOC-containing exhaust gases; and
- crushing the wood chips 500 in a refiner 50 configured to discharge G6 VOC-containing exhaust gases.

According to a preferred embodiment of the disclosure according to FIG. 1 it is provided that the first thermal treatment device 10 is configured to receive G1 VOC-containing exhaust gases, which are discharged from the second thermal treatment device 30 G3, the digester 40 G5 and the refiner 50 G6.

According to a preferred embodiment of the disclosure, it is provided according to FIG. 1 that the second thermal treatment device 30 is configured to receive G2 VOC-containing exhaust gases, which are discharged from the digester 40 G5 and the refiner 50 G6.

According to a preferred embodiment of the disclosure it is provided that the VOCs are discharged from the first thermal treatment device 10, the second thermal treatment device 30, the digester 40 and/or the refiner 50. This is not shown in greater detail in FIG. 1.

According to a preferred embodiment of the disclosure it is provided that the processing system 1 preferably comprises a stuffing screw along a material flow between the second thermal treatment device 30 and the digester 40, wherein the VOCs are discharged from the processing system 1, in particular from the washing device M2X and/or in particular from the stuffing screw M3X. Further optionally or additionally provided is that the processing system 1 comprises a discharge screw along a material flow between the digester 40 and the refiner 50, wherein the VOCs from the processing system 1 are discharged M4X from the discharge screw. The discharge screw can be designed as a stuffing screw.

According to a preferred embodiment of the disclosure it is provided that the first thermal treatment of the wood chips 100 is carried out at 80 degrees Celsius for 5 to 10 minutes; and/or the second thermal treatment of the wood chips 300 is carried out at 100 degrees Celsius for 5 to 10 minutes; and/or the cooking of the wood chips 400 is carried out between 140 to 180 degrees Celsius for 2 to 5 minutes; both the temperature data as well as the time data preferably include a respective deviation upwards and/or downwards of 10 percent inclusive.

According to a preferred embodiment of the disclosure, it is provided that the first thermal treatment device 10 is heated at least partially, preferably completely, by exhaust gases from the digester 40.

According to a preferred embodiment of the disclosure, it is provided according to FIG. 1 that the VOC-containing exhaust gases from the digester 40 and the refiner 50 are forwarded in a combined manner.

According to a preferred embodiment of the disclosure according to FIG. 1, it is further provided that the VOC-containing exhaust gases of the second thermal treatment device 30, the digester 40 and the refiner 50 are forwarded in a combined manner.

According to a preferred embodiment of the disclosure according to FIG. 1, it is provided that the digester 40 is configured to receive VOC-containing exhaust gases G4, which are discharged from the digester 40 G5 and the refiner 50 G6.

According to a preferred embodiment of the disclosure according to FIG. 1, it is provided that the VOC-containing exhaust gases are introduced into a bottom section of the digester 40, the first and the second thermal treatment device 10, 30.

According to a preferred embodiment of the disclosure according to FIG. 1, it is provided that the material flow of the wood chips occurs from the first thermal treatment device 10 into the washing device 20 M1;

the washing device 20 into the second thermal treatment device 30 M2;

the second thermal treatment device 30 into the digester 40 M3; and the digester 40 into the refiner 50 M4.

The foregoing description of the embodiment has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A method for reducing volatile organic compounds, VOC, from wood chips for wood fibre production in a processing system, comprising at least the following successive steps:

first thermal treatment of the wood chips with water and/or steam in a first thermal treatment device adapted to receive exhaust gases containing VOCs;

cleaning of the wood chips in a washing device;

second thermal treatment of the wood chips with water and/or steam in a second thermal treatment device which is designed to receive and separate exhaust gases containing VOCs;

cooking the wood chips with water and/or steam in a digester adapted to receive and remove VOC-containing flue gases; and crushing the wood chips in a refiner adapted to remove VOC-containing exhaust gases, wherein the material flow of the wood chips is from the first thermal treatment device into the washing device;

from the washing device into the second thermal treatment device;

from the second thermal treatment device into the cooker; and from the cooker into the refiner, and wherein the exhaust gases containing VOCs are mixed with the water and/or steam in the respective thermal treatment device and digester.

2. The method for reducing volatile organic compounds, VOC, from wood chips for wood fibre production according to claim 1, wherein the first thermal treatment device is designed to receive exhaust gases containing VOCs, which are separated from the second thermal treatment device, the digester and/or the refiner.

3. The method for reducing volatile organic compounds, VOC, from wood chips for wood fibre production according to claim 1 wherein the second thermal treatment device is adapted to receive VOC-containing exhaust gases which are discharged from the digester and/or the refiner.

4. The method for reducing volatile organic compounds, VOCs, from wood chips for wood fibre production according to claim 1, wherein the VOCs are discharged from the processing system from the first thermal treatment device, the second thermal treatment device, the digester and/or the refiner.

5. The method for reducing volatile organic compounds, VOCs, from wood chips for wood fibre production according to claim 1, wherein the VOCs from the processing system are discharged from the washing device and/or that the processing system comprises a stuffing screw along a material flow between the second thermal treatment device and the digester, wherein the VOCs from the processing system are discharged from the stuffing screw and/or that the processing system comprises a discharge screw along a material flow between the digester and the refiner, wherein the VOCs from the processing system are discharged from the discharge screw.

6. The method for reducing volatile organic compounds, VOCs, from wood chips for wood fibre production according to claim 1, wherein the first thermal treatment of the wood chips is carried out at 80 degrees Celsius for 5 to 10 minutes; and/or the second thermal treatment of the wood chips is carried out at 100 degrees Celsius for 5 to 10 minutes; and/or cooking the wood chips between 140 to 180 degrees Celsius for 2 to 5 minutes.

7. The method for reducing volatile organic compounds, VOC, from wood chips for wood fibre production according to claim 1, wherein the first thermal treatment device is heated at least partially by exhaust vapours from the digester.

8. The method for reducing volatile organic compounds, VOC, from wood chips for wood fibre production according to claim 1, wherein the exhaust gases containing VOCs from the digester and the refiner and optionally also from the second thermal treatment device are passed on together.

9. The method for reducing volatile organic compounds, VOC, from wood chips for wood fibre production according to claim 1, wherein the digester is designed to receive VOC-containing exhaust gases, which are separated from the digester and/or the refiner.

10. The method for reducing volatile organic compounds, VOC, from wood chips for wood fibre production according to claim 1, wherein the exhaust gases containing VOCs are introduced into a bottom section of the digester, the first and/or the second thermal treatment device.

* * * * *